US006148716A

United States Patent [19]

Swank

[11] Patent Number: 6,148,716

[45] Date of Patent: Nov. 21, 2000

[54] LOW NOISE HIGH EFFICIENCY POSITIVE DISPLACEMENT PUMP

[75] Inventor: Robert P. Swank, Mansfield, Ohio

[73] Assignee: Impact MST Incorporated, Cincinnati, Ohio

[21] Appl. No.: 09/212,761

[22] Filed: Dec. 16, 1998

[51] Int. Cl.[7] ..... F01B 9/02

[52] U.S. Cl. ..... 92/137

[58] Field of Search ..... 92/137

[56] References Cited

U.S. PATENT DOCUMENTS

| | | | |
|---|---|---|---|
| 1,468,664 | 9/1923 | Hales | 92/137 |
| 1,660,487 | 2/1928 | Gauthier | 123/197.1 |
| 3,014,463 | 12/1961 | Krohm | 92/137 |
| 3,868,932 | 3/1975 | Toth | 123/197.1 |
| 4,990,062 | 2/1991 | Swank . | |
| 5,228,840 | 7/1993 | Swank . | |
| 5,484,268 | 1/1996 | Swank . | |
| 5,660,151 | 8/1997 | Yoshizawa . | |

*Primary Examiner*—F. Daniel Lopez
*Attorney, Agent, or Firm*—Wood, Herron & Evans, L.L.P.

[57] ABSTRACT

A positive displacement pump is provided having a housing, a plurality of pistons and an eccentric drive element rotatably mounted about an axis on the housing. A rigid compression member connected to each of the pistons is reciprocatably moveable with the pistons relative to the housing. At least one tension member is provided, connected between each of the pistons and the eccentric drive element at a point displaced from the axis. The tension member is permanently maintained in tension so as to continuously exert force radially inwardly on each of the pistons and to cause each of the pistons to continuously exert radially inward force on the compression member to permanently maintain the compression member in compression. The plurality of pistons preferably includes one or more pairs of pistons with each piston of the pair linked together by the compression element and reciprocates each in synchronism and 180° out of phase with the other. The tension member preferably includes a transversely flexible elongated element connected at an inner end to the eccentric drive element at the point displaced from the axis and linked at an outer end to at least one of the pistons. The tension member preferably also includes a plurality of transversely flexible elongated elements, each connected at an inner end to the eccentric drive element at the point displaced from the axis and each linked at an outer end to one of the pistons.

15 Claims, 9 Drawing Sheets

LOW NOISE HIGH EFFICIENCY POSITIVE DISPLACEMENT PUMP

This invention relates to positive displacement pumps and, more particularly, to positive displacement pumps of the type that are utilized in high efficiency low noise applications.

BACKGROUND OF THE INVENTION

Positive displacement pumps are characterized by alternately filling and emptying an enclosed volume by reciprocation of a piston in a cylinder, by the meshing of gears in an enclosed housing, or by the use of sliding veins, turning screws and other elements that can vary the volume of a pumping chamber. With a reciprocating piston, for example, the piston is moveable in an enclosed chamber in an intake stroke in which negative pressure is created within the chamber to draw fluid into the chamber and an exhaust stroke in which positive pressure is applied to the fluid in the chamber to expel it from the chamber. Such a reciprocating piston works in conjunction with valve structure which alternately respectively opens and closes inlets and outlets to the chamber so that the fluid flows in a desired direction through the pump. The pistons are often driven through drive linkages that include a series of shafts, rods and pins that move in bearings or guides. Examples of such linkages are found in gear, vein, screw and other positive displacement pumps.

One problem associated with positive displacement pumps of the past is that they typically produce vibration and noise, much as a result of the action of forces between and within the components of the linkages and pumping elements. Such noise is excessive for many applications, requiring substantial increases in volume, cost and energy consumption to muffle or suppress the vibrations or noise.

Another problem associated with positive displacement pumps of the past is that the interfaces between the components of the linkages and other surfaces require lubrication to reduce wear and to ensure smooth operation of the pump. Lubricants that are available to provide such lubrication often make their way into the fluid that is being pumped and thereby provide a source of contamination of the fluid. In air or other gas pumps where the mixture of the fluid with the lubricant becomes hazardous, or in chemical manufacturing or medical applications where the presence of the lubricant as a contaminant can ruin the material being produced or can present a danger to a patient being treated, the lubricants cannot be used to the extent needed, so the lubrication function is compromised.

A further problem with positive displacement pumps of the past has been their limited capability to dissipate heat generated by moving parts, particularly with high operating speeds, with the compression of gases taking place, and with metal-to-metal or other surface-to-surface contact taking place between linkage components and other surfaces. Such temperature can adversely affect the fluid being pumped and can result in damage to the pump.

An additional problem of positive displacement pumps of the past is the difficulty in restarting of the pump, particularly where outputs are pressurized. This problem has required the use of bleeder valves or other approaches which increase the complexity of the pump and the cost.

Attempts of the prior art to solve such problems have included the use of centrifugal pumps in which cylinders and pistons are rotated and the momentum of the pistons provides the force needed to move the pistons in a radially outward direction with mechanical linkages being provided for pulling the pistons radially inward. Such linkages are connected eccentrically to a stationary element so that each piston is alternately pulled radially inwardly and then allowed to move radially outwardly as the cylinder structure of the pump carrying the piston rotates about a central axis. Many centrifugal pumps have required excessive energy to operate and have been ineffective in reducing the noise problem.

Solutions to many of the above problems have been presented by the centrifugal pumps provided by Applicant as described in U.S. Pat. Nos. 4,990,062; 5,228,840 and 5,484,268, each owned by the assignee of the present application and each hereby expressly incorporated herein by reference. Such patents disclose centrifugal pumps including embodiments in which pistons are connected by linkages formed of non-elastic flexible elements connected to a fixed cam or roller to move the pistons inwardly as the unit rotates while allowing them to move outwardly by centrifugal force. Such pumps are particularly suitable for use in such devices as oxygen concentrators, particularly those for use in providing oxygen therapy to individual human patients. Oxygen concentrators which use such pumps are described and illustrated in the copending and commonly assigned U.S. patent application Ser. No. 08/745,281, filed Nov. 8, 1996, now U.S. Pat. No. 5,827,858 entitled "Rapid Cycle Pressure Swing Adsorption Oxygen Concentration Method and Apparatus", hereby expressly incorporated herein by reference.

Centrifugal pumps, however, rely upon the mass of the pistons or other rotating elements to develop the forces necessary to move the pumping elements radially outward. Such masses present design limitations on the pumps and on systems incorporating such pumps which can be undesirable for certain applications. Centrifugal pumps thus have been accompanied by certain disadvantages including the disadvantages of a higher than desirable weight and larger size than desirable in many applications.

Accordingly, there remains a need for a solution to the problems presented by positive displacement pumps of the prior art which do not possess the disadvantages of centrifugal pumps.

SUMMARY OF THE INVENTION

A primary objective of the present invention is to provide an improved positive displacement pump. Among particular objectives of the present invention are: to provide a positive displacement pump having a high efficiency; to provide a positive displacement pump that produces low levels noise and vibration; to provide a positive displacement pump that requires little or no lubrication; to provide a positive displacement pump that does not produce high amounts of heat; and to provide a positive displacement pump that is compact, light weight and has moving parts that operate at low momentum or inertia.

According to the principles of the present invention, a positive displacement pump is provided having pistons connected to a drive mechanism by two drive links, one which is a rigid link that is maintained in constant compression and the other which is a non-elastic flexible link that is maintained in constant tension. Preferably, the two links that are connected to a piston are arranged parallel so that the tension in one link opposes the compression of the other link connected to the piston, the magnitudes of the tension and compression forces differing in an amount equal to the other forces that affect the piston, particularly the operable pressure on the piston as well the inertial force due to the mass of the piston itself and the friction resulting from the motion of the piston.

In accordance with the preferred embodiment of the invention, a positive displacement pump is provided which has a plurality of pistons, preferably configured in one or more opposed pairs. Such a configuration is particularly suitable with the pistons arranged in a radial pattern equally angularly spaced in a plane, or in parallel planes, around a common axis. On the axis is provided a rotatable drive shaft that is driven by a motor. Fixed to the shaft at the center of the array of pistons is a disc which is rotatable in a bearing mounted in an orbital plate to which one point on each of the non-elastic flexible tension members is secured. At least one tension member is provided for each piston, and each tension member may be formed of a separate length of flexible non-elastic cord or belt like structure or may be formed of one or more sections of a continuous cord or belt like structure that forms the tension for each of a plurality of pistons.

The pistons, where provided in one or more opposed pairs, preferably are interconnected with a length of rigid rod that constitutes the compression link for each of the pistons. Preferably, the opposed pistons of each pair are assembled in such a way that they are at the opposite terminal ends of the compression rod which is suspended between the two pistons. The pistons are preferably mounted to slide in a radial direction in respective stationary cylinders that are fixed to a pump housing or frame. The compression member, upon initial assembly, is not subjected to compressive forces. However, it is placed in compression by the installation and tensioning of the tension elements upon their installation into the pump assembly. The amount of tension is such that, as the pump operates through its cycles of operation, the magnitudes of the compressive force in the compression elements oscillates with the reciprocating motion of the piston while the tensile force in the tension elements also oscillates with the reciprocating motion of the piston. However, the magnitude of the fluctuations of these forces is less than the constant component of the force to which the elements are adjusted upon assembly. In this way, the force in the tension element is always in tension while the force in the compression element is always in compression. As a result, the direction of the forces at the interconnecting points of the elements do not oscillate, and vibration and noise that would be generated by such oscillation do not occur.

In certain embodiments of the invention, the pistons are provided in opposed pairs of radially reciprocating pistons arranged on opposite sides of a diameter of an assembly that has a rotatable driving element at its center. The pistons of the pair are interconnected by a compression element that is rigidly connected to the two pistons of the pair. Each piston is interconnected by a tension element to the driving element. An eccentric linkage mechanism is provided in series with the tension element between the center driving element and the piston so that the piston is periodically pulled radially inwardly by the tension element upon each rotation of the driving element. As each piston is pulled radially inwardly in this manner, the opposite piston of the pair is pushed outwardly as the inwardly pulled piston pushes radially inwardly one end of the compression element which causes the compression element to push radially outwardly the other end of the compression element driving the opposite piston outwardly. In this way, one piston of a pair is moved through an intake stroke while the other piston of the pair is moved through an output stroke. The only forces applied by the driving element are in the nature of tensile forces through the tension elements even though one piston of a pair is being pulled radially inwardly while the other piston of the pair is being pushed outwardly, with the outward pushing of pistons being accomplished indirectly through the compression elements by forces applied through the tension on the other piston.

In certain embodiments of the invention, the driving element includes an eccentric member fixed to the end of a motor shaft that is concentric with the center of the assembly. The tension elements are connected to the eccentric element at a point displaced radially from the axis at the center. The other end of each tension element is fixed to a piston.

In other embodiments, an endless belt is provided that is eccentrically and non-slidably connected to the driving element at an inner portion of its loop while extending around a post or other such structure that is fixed relative to a piston. Such an endless belt may be a separate belt for each of the pistons or may be a single belt that similarly connects each of the pistons with various parts of the belt fixedly connected to the driving element.

In further embodiments of the invention, an endless belt tension element may be provided for each piston with the belt mounted to rotate about a pulley or roller on the driving element at the center of the assembly and about a similar pulley or element at the piston end the extent of the tension element. In such embodiments, the pulley or roller at either the inner or outer extents of the tension element may be eccentrically mounted.

The present invention provides a pump with multiple pistons and cylinders, and preferably multiple piston-cylinder pairs, having few bearings. In the preferred embodiment, no bearings are provided other than a single bearing that might be desired for the mounting of a drive motor or driving element at the center of the pump assembly. Piston wobble, which occurs with certain pumps where the pistons are linked to an eccentric drive by rigid links, is avoided with pumps of the present invention. The pumps of the present invention have less mass, require less volume, and have less inertia than centrifugal and many other pumps of the prior art. Pistons of the preferred embodiments of the pumps of the present invention move in straight line motions that provide greater seal life, less vibration and noise, and greater efficiency than wobble-seal and other prior art pumps.

These and other objectives and advantages of the present invention will be more readily apparent from the following detailed description of the drawings of the preferred embodiment of the invention.

DETAILED DESCRIPTION OF THE DRAWINGS

Figure 1:
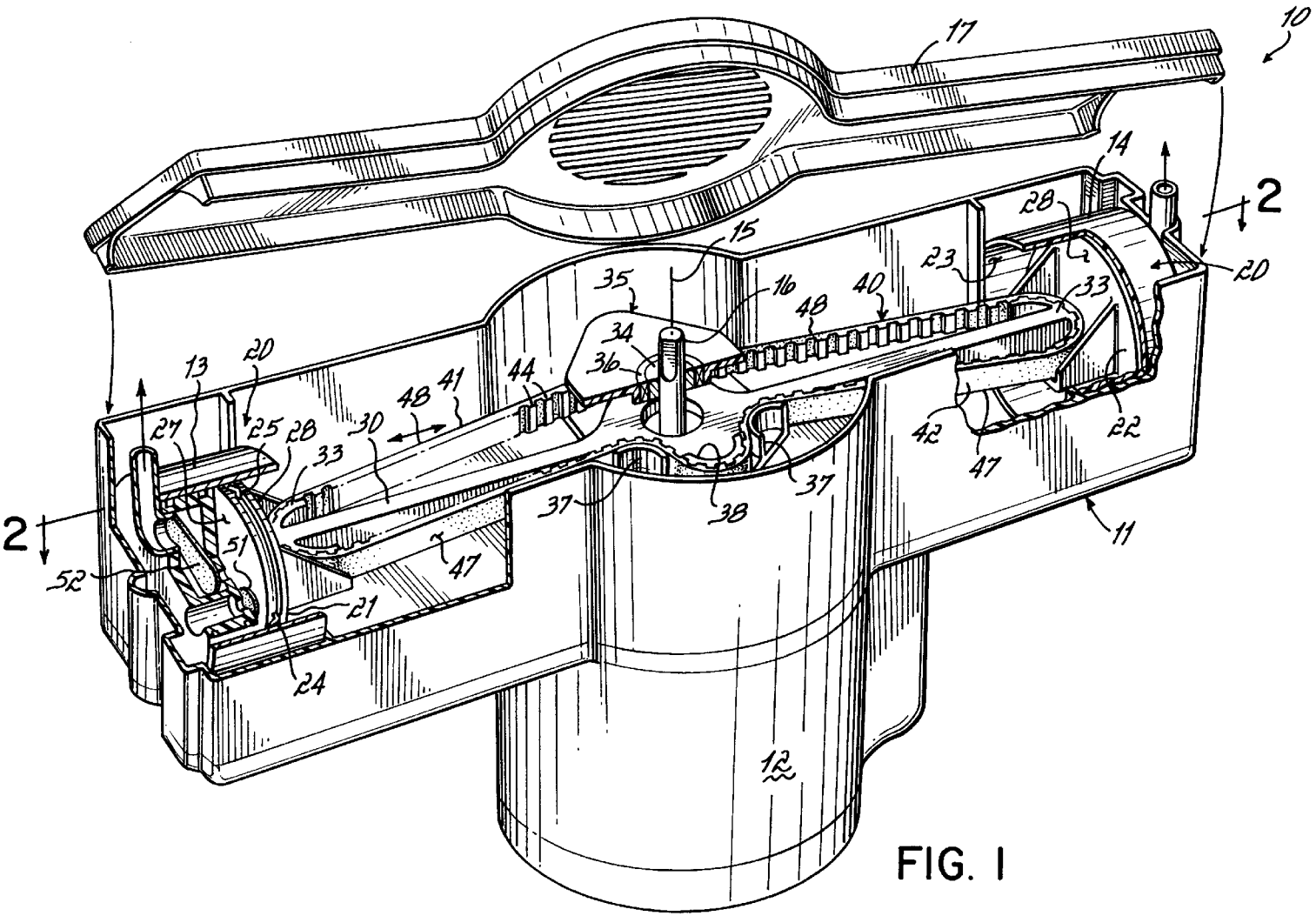
FIG. 1 is a perspective view of one form of a positive displacement pump embodying principles of the present invention.

A positive displacement pump 10, according to one embodiment of the present invention, is illustrated in FIG. 1. The pump 10 includes a pump housing 11 that is fixed to the housing of a motor 12. The pump 10 is a two cylinder embodiment that includes two diametrically opposed radial cylinders 13, 14 of a piston and cylinder pair 20. The cylinders 13,14 of the pair 20 are fixed relative to the housing at equal radial distances from an axis 15 of the housing 11. The motor 12 has a rotary output shaft 16 that extends into the housing 11. The pump 10 is connected to the motor 12 such that the output shaft 16 of the motor 12 lies on the axis 15 of the housing 11. The housing 11 has a cover 17 that encloses the pistons 13 and 14 within the housing 11.

Figure 2:
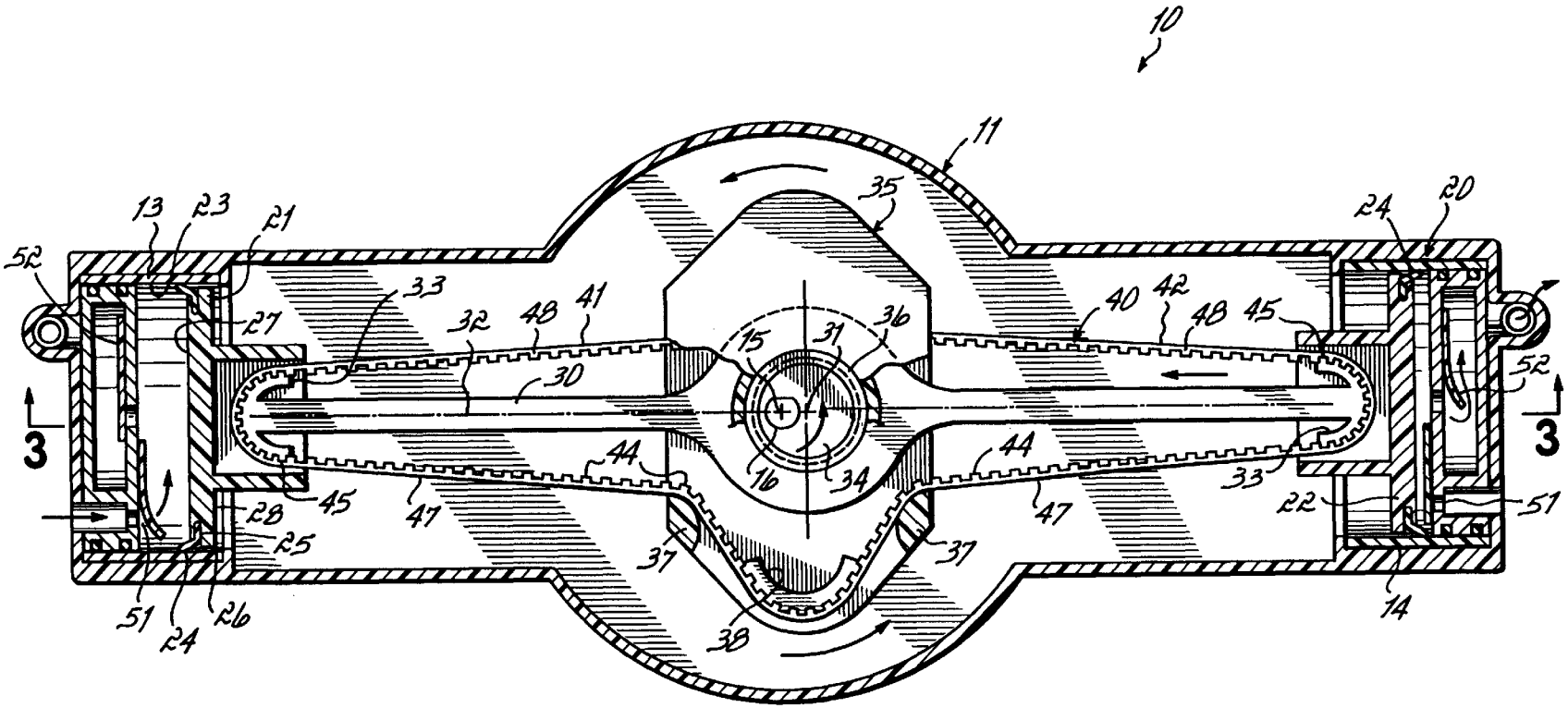
FIG. 2 is a sectional view along the line 2—2 of FIG. 1 illustrating the pistons moving toward and approaching the rightmost end of their strokes.

Each of the cylinders 13,14 of the cylinder pair 20 has a respective piston 21,22 therein that is slidably mounted within the cylinder 13,14, and making a sealed sliding contact with inner wall 23 of each cylinder 13,14 through an annular seal 24 resides in an annular groove 25 around the rim 26 of each cylinder 13,14 as best shown in FIG. 2. Each piston 21,22 has a face 27 that faces radially outwardly from the axis 15 and toward the interior of the respective cylinder 13,14 as best shown in FIGS. 1–3A. Each piston also has a back side 28 that faces toward the axis 15. Rigidly connected to each of, and extending between, the pistons 21,22 is the compression rod 30. The rod is symmetrical about its midpoint 31 and has a longitudinal centerline 32 that intersects with the axis 15 of the housing 11, as can be seen more clearly in FIG. 2. The rod 30 may be integrally formed as a unit with both of the pistons 21,22 so that the pistons constitute the opposite ends of the rod 30. Fixed to the pistons 13,14, either directly on the back face 28 of the piston 13,14 or indirectly by being situated on the rod 30, is a tension member connection post or similar structure 33.

Rigidly connected to the shaft 16 of the motor 12 is an eccentric disc 34 which rotates in a drive plate 35 on which it is secured in a bearing 36. The rotation of the shaft 16 rotates the eccentric disc 34 which drives the plate 35 in an orbital but non-rotating motion. The compression rod 30 is configured in the area of its midpoint 31 to remain out of contact with the shaft 16 of the motor 12 and the eccentric disc 34 and the drive plate 35. The rod 30 is also preferably completely supported by the pistons 21,22 at its ends which are intern supported only through the seals 24 by the cylinders 13,14 which are rigidly fixed to the housing 11.

Figure 2A:
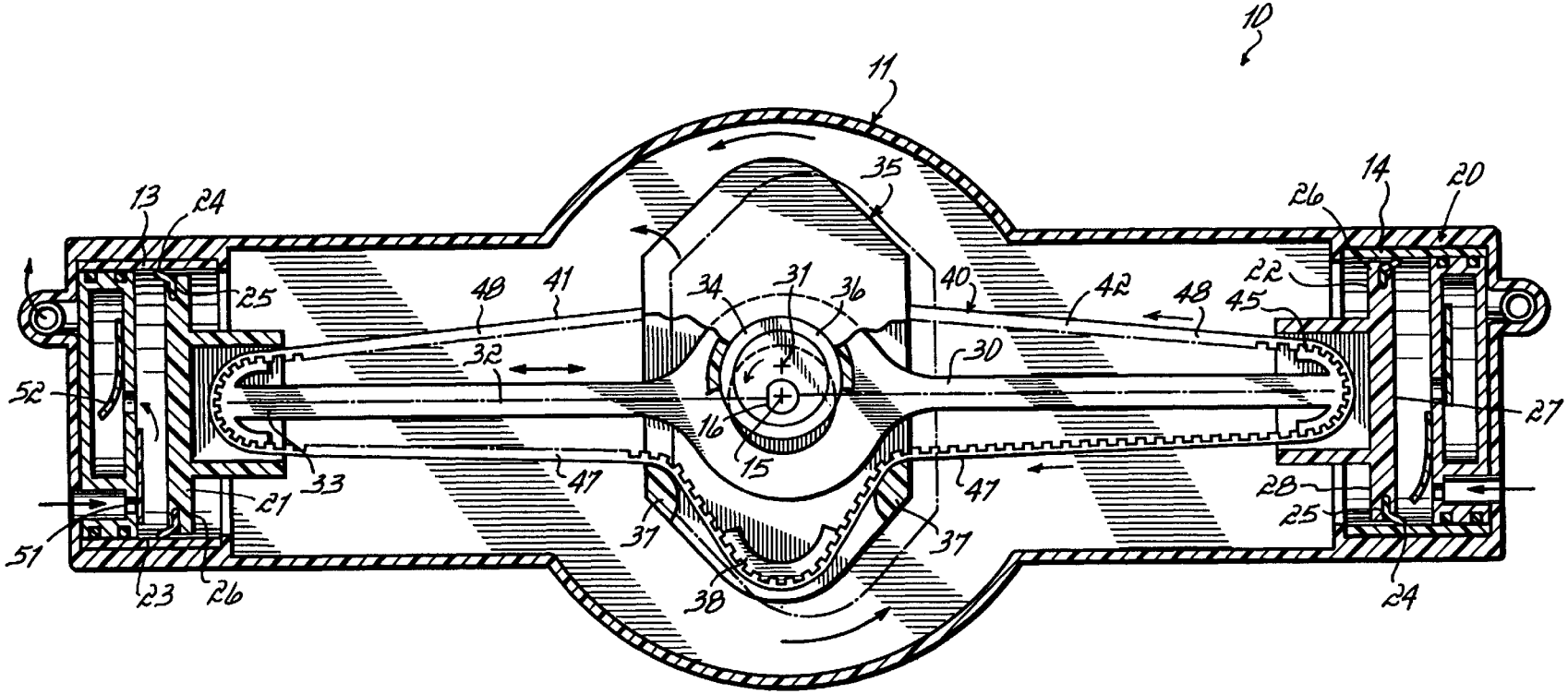
FIG. 2A is a sectional view similar to FIG. 2 illustrating the pistons moving toward the left and in at about the approximate midpoint of their stroke.

The plate 35 has respective internal and external tension mounting elements 37,38 thereon. Connected between the elements 37,38 on the plate 35 and the posts 33 on the pistons 21,22 are tension members 41,42, both formed of the same endless belt 40 of non-elastic but flexible material. Such a belt 40 may include an elastic molded polymer matrix material in which is encased longitudinal fibers or cords of steel or other metal, or preferably, of high strength plastic material such as high strength polyethylene or aramid fibers such as those respectively marketed under the trademarks SPECTRA and KEVLAR. Such belts have the property that they are non-elastic, that is, they do not stretch longitudinally, yet they are flexible in that they will bend transversely. Accordingly, they provide flexibility but do not change length under load, allowing relative transverse movement while maintaining the spacing of the structures to which it is connected.

Where an endless belt 40 is used to provide the tension members 41,42, structure is provided at the disc 35 to prevent the belt from slipping, which would change the lengths of the members 41,42 causing the uppermost and lowermost positions of the pistons 21,22 in the cylinders 13,14 to shift, which is undesirable. Slippage can be prevented by providing lugs 44 on one or both sides of the belt 40 and mating cogs 45 on the tension mounting elements 37,38 and/or the posts 33. The belt 40 may be secured so that the sides 47,48 of the tension elements 41,42 be substantially parallel, as illustrated, or so that they diverge at some angle that minimizes the change in tension on the belt 40 as the plate 35 moves transversely to the longitudinal axis 32 of the compression member 30. The divergence can be such that the shortening of one side 47 of the belt 40 along the tension elements 41,42 offsets the lengthening of the other side 48 of the belt 40 in the most optimal way. This result can be facilitated by allowing limited play in the tension elements 41,42, such as by sideways motion that may cause the changing of the tension is illustrated in FIG. 2A. Preferably, however, a limited amount of slack 79 is provided, as illustrated in connection with belt 80 in FIG. 10.

Figure 10:
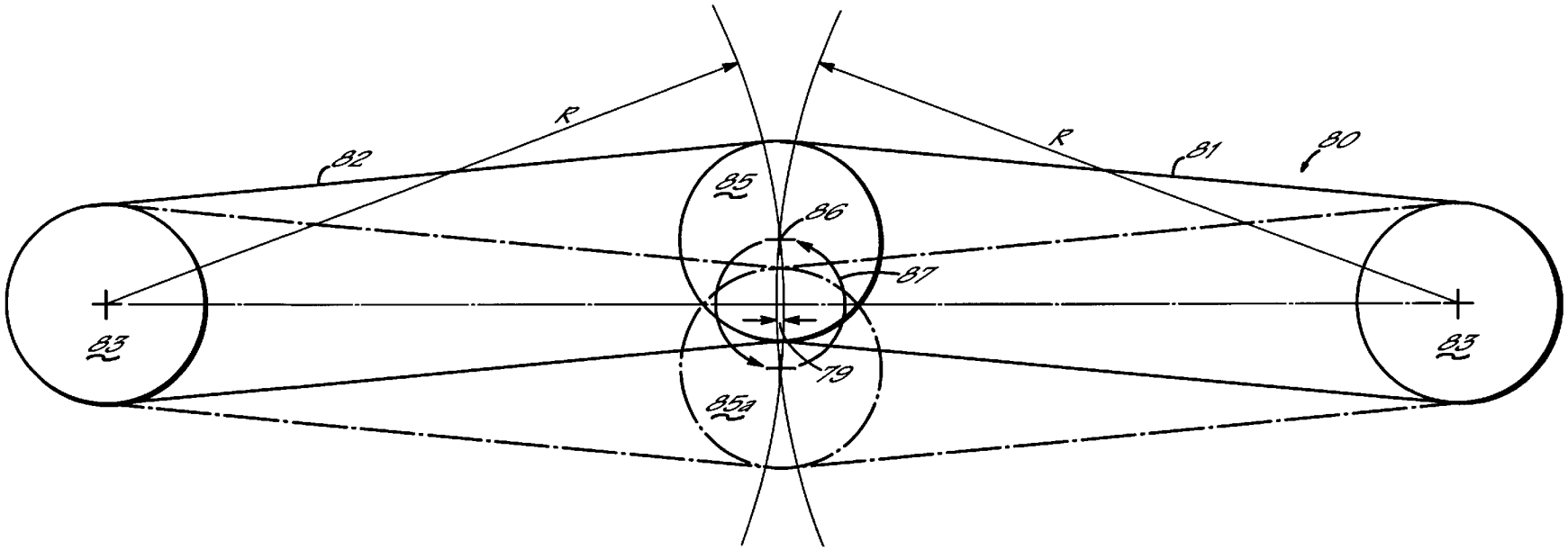
FIG. 10 is a diagram illustrating linkage configuration of one embodiment of the invention.

Referring to FIG. 10, fixed posts 83 on opposed pistons (not shown) are provided with cogs (not shown) or other structure to prevent slipping of the two individual belts 81,82 of the belt set 80 thereon. The belts 81,82 encircle a pair of stacked cogged discs 85 that are driven by an eccentric drive pin 86 in a circular orbit 87. The discs 85 are illustrated in their two sidemost positions, one, 85, shown as a solid line and one, 85*a*, shown in phantom. The total sideways motion of the discs 85 is the diameter of the circular orbit 87. The lengths R of the belts 81,82 are selected such that, when at the sidemost positions of the discs 85, the belts are fully extended. As a result, when slack 79 or an overlap of the belts 81,82 occurs. This overlap prevents an overtensioning of the belts 81,82 when in their sidemost positions. With the slack 79, the belts 81,82 are not entirely taut, but are compliant enough to allow for the sideways motion, but are not so loose that the belts whip or develop a traveling or standing wave form at high frequency operation, with a belt of appropriately selected stiffness and mass.

A movement of the components of the pump 10 during a cycle of operation of the pump 10 can be determined from FIGS. 2 and 2A. In FIG. 2, the pump 10 is illustrated with the shaft 16 rotating on the axis 15 to rotate the disc 35 counterclockwise in the figure. This rotation moves the disc 35 in an orbit around the axis 15 and carries the tension mounting elements 37 and 38 in similar orbital paths. These paths change the positions of the elements 37,38 relative to the cylinders 13,14 so as to pull the piston 21 radially inwardly toward the axis 15 in FIG. 2. This operates the cylinder 13 in an input cycle in which air is drawn into the cylinder 13 through an inlet check valve 51 in the cylinder 13. At the same time, the inward motion of the piston affects a rightward motion (in the figure) of the compression element 30, which pushes the piston 22 radially outwardly compressing air in the cylinder 14 and expelling it out of the cylinder through an outlet check valve 52. The force to move the piston 21 inwardly is applied by the motor 12 through the shaft 16 and the plate 35 and via the tension element 41 to the piston 13. The force to move the piston 22 outwardly is similarly supplied by the motor 12 through the shaft 16 and the plate 35 and via the tension element 41 and further through compression element 30 to the piston 22. The initial tension of the belt 40 is set such that, during this portion of the cycle of the pump 10, residual tension remains in the tension element 42.

When the pistons 21,22 reach and pass their rightmost positions in the figures, the inlet valve 51 in the cylinder 13 and the outlet valve 52 in the cylinder 14 close as the pistons begin to reverse direction from that toward the right in the figures and toward the left. At this point in the cycle, the valve 51 in the cylinder 14 opens, beginning its intake stroke, and the valve 52 in the cylinder 13 opens, beginning its output stroke. In this portion of the cycle, the force to move the piston 14 inwardly is applied by the motor 12 through the shaft 16 and the plate 35 and via the tension element 42 to the piston 14. The force to move the piston 13 outwardly is similarly supplied by the motor 12 through the shaft 16 and the plate 35 and via the tension element 42 and, further, through compression element 30 to the piston 13. The initial tension of the belt 40 is set such that, during this portion of the cycle of the pump 10, residual tension remains in the tension element 41.

Figure 4:
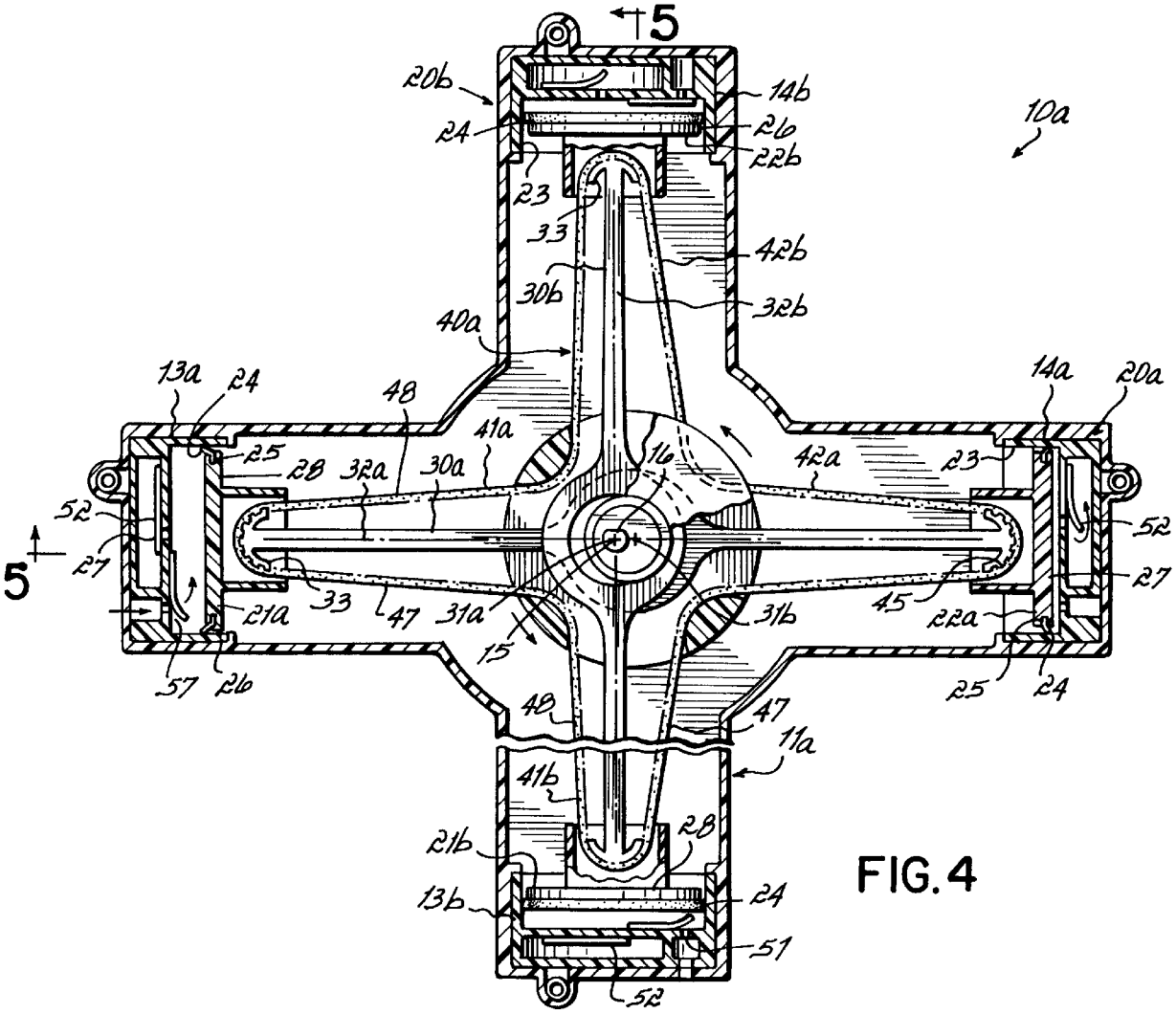
FIG. 4 is a view, similar to FIG. 2, of another embodiment of the invention.
Figure 5:
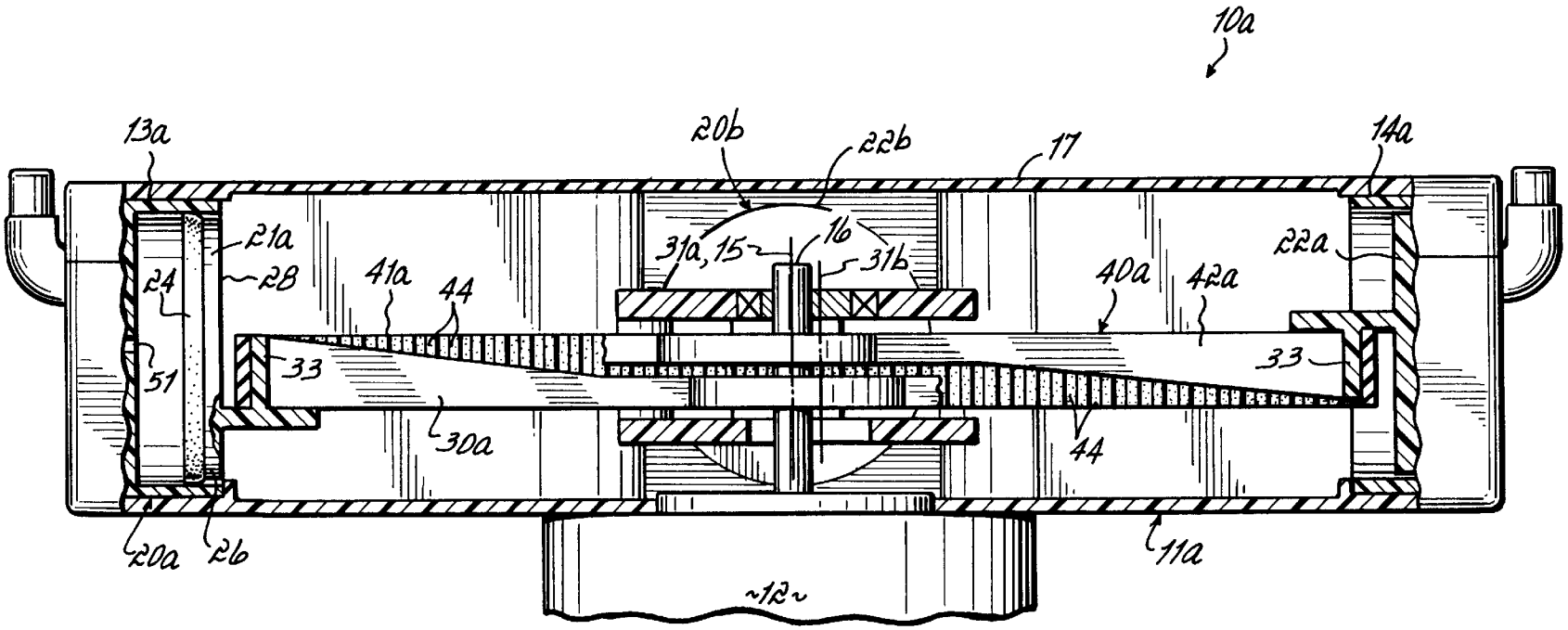
FIG. 5 is a cross-sectional view taken along the line 5—5 of FIG. 4.

The opposed pair 20 of cylinders of the pump 10 described above is adaptable for use in a pump 10*a* having multiple pairs 20 of cylinders 13,14. In FIGS. 4 and 5, the pump 10*a* is provided with a pump housing 11*a* that is fixed to the housing of motor 12. The pump 10*a* is a four cylinder embodiment having two pairs 20 of diametrically opposed radial cylinders 20*a*,20*b*, each pair 20*a*,20*b* including cylinders 13,14. The cylinders 13,14 are fixed relative to the housing 11*a*, as with the housing 11 of the embodiment 10 above, at equal radial distances from the axis 15 of the housing 11*a*. The rotary output shaft 16 of the motor 12 extends into the housing 11*a* and lies on the axis 15.

Each of the cylinders 13*a*,14*a*,13*b*,14*b* of the cylinder pairs 20*a*,20*b* has a respective piston 21*a*,22*a*,21*b*,22*b* slidably mounted therein in sealed sliding contact with inner-wall 23 of each cylinder 13*a*,14*a*,13*b*,14*b* through annular seal 24 residing in annular groove 25 around rim 26 of each piston 21*a*,22*a*,21*b*,22*b*. Rigidly connected to each of, and extending between, the pistons 21*a*,22*a*,21*b*,22*b* of each cylinder pair 20 is a compression rod 30*a*,30*b*. Cylinder pair 20*a* includes the compression rod 30*a* while cylinder pair 20*b* includes the compression rod 30*b*. Each rod 30*a*,30*b* is symmetrical about its respective midpoint 31*a*,31*b* and each has a respective longitudinal centerline 32*a*,32*b* that intersects with the axis 15 of the housing 11*a*, as can be seen in FIG. 4. The rods 30 are preferably integrally formed as a unit with both of the pistons 21*a*,22*a*,21*b*,22*b* of each pair 20*a*,20*b* so that the pistons 21*a*,22*a* constitute the opposite ends of the rod 30*a* while the pistons 21*b*,22*b* constitute the opposite ends of the rod 30*b*. The rods 30*a*, 30*b* are configured to cross each other in the vicinity of the axis 15 so that they do not contact each other as they move. Each of the pistons 21*a*,22*a*,21*b*,22*b* has a tension member connection post 33 preferably situated such that all of the posts 33 lie in a common plane when the pistons 21*a*,22*a*,21*b*,22*b* are mounted in the housing 11*a*.

The pump 10*a* has an eccentric disc 35*a* rigidly connected to the shaft 16 of the motor 12. The compression rods 30*a*,30*b* are configured in the area of their midpoints 31*a*, 31*b* to remain out of contact with the shaft 16 of the motor 12 and the eccentric disc 35*a*. Each rod 30 is also preferably completely supported by the pistons 21*a*,22*a*,21*b*,22*b* at its ends which are in turn supported only through the seals 24 by the cylinders 13,14 which are rigidly fixed to the housing 11*a*.

The plate 35*a* has only internal tension mounting elements 37*a* thereon. Alternatively, connected between the elements 37*a* on the plate 35*a* and the posts 33 on each of the pistons 21*a*,22*a*,21*b*,22*b* which may be identified as pistons 21*a*,22*a*,21*b*,22*b* are respective tension members 41*a*,42*a*,41*b*,42*b*, each formed, in the embodiment 10*a*, of the same endless belt 40*a* of the non-elastic but flexible material.

Where an endless belt 40*a* is used to provide the tension members 41*a*,42*a*,41*b*,42*b*, structure is provided either at the disc 35*a* or on the posts 33, or both, to prevent the belt from slipping. For example, the belt 40*a* may be provided with lugs 44 on one or both sides thereof, and the tension mounting elements, 37*a* and/or the posts 33 may be provided with mating cogs 45 thereon, to prevent the sliding of the belt 40*a*. In the embodiment 10*a*, cogs 45 are only provided on the posts 33. In this arrangement, the posts 33 of one of the pairs 20 serve functions of the external tension mounting elements 38 in the embodiment 10. The belt 40*a* may be secured so that the sides 47,48 of the tension elements 41,42 are parallel, as with the pump 10, or so as to diverge at some angle that minimizes the change in tension on the belt 40*a* as the plate 35*a* moves transversely to the longitudinal axes 32*a*,32*b* of the compression members 30, as illustrated in FIG. 4.

A movement of the components of the pump 10*a* during a cycle of operation is similar to that of the components of pump 10 of FIGS. 2 and 2A. The motions of the components of the pairs 20*a*,20*b* in the two pair pump 10*a* that is illustrated in FIGS. 4 and 5 are each similar to that of the components of pair 20 in the pump 10 except that the cycle of pair 20*a* is 90° out of phase with that of pair 20*b* due to the perpendicular arrangement of the pairs 20*a*,20*b* relative to each other and their linkage to the common eccentric disc 35*a* to drive them.

With the shaft 16 rotating on the axis 15 to rotate the disc 35*a* counterclockwise in the figure, disc 35*a* moves in an orbit around the axis 15 and carries the tension mounting elements 37*a* in similar orbital paths. In FIG. 4, the disc 35*a* is illustrated as it approaches its rightmost position in the figure, still moving to the right and upwardly in the figure. The path changes the positions of the elements 37*a* relative to the cylinders 13,14 of each pair 20 so as to pull the pistons 21*a*,21*b* radially inwardly toward the axis 15 in FIG. 4. This operates each of the cylinders 13*a*,13*b* in its respective input cycle in which air is drawn into the cylinders 13*a*,13*b* through its respective inlet check valve 51. At the same time, the inward motion of the pistons 21*a*, 21*b* affects a rightward motion (in the figure) of the compression element 30*a* and an upward motion of the compression element 30*b*, which pushes the pistons 22*a*,22*b* radially outwardly compressing air in the cylinders 14*a*,14*b* and expelling the air out of the respective cylinders through a respective outlet check valve 52. The force to move the pistons 21*a*, 21*b* inwardly is applied by the motor 12 through the shaft 16 and the plate 35*a* and via the tension elements 41*a*,41*b* to the pistons 21*a*,21*b*. The force to move the pistons 22*a*,22*b* outwardly is similarly supplied by the motor 12 through the shaft 16 and the plate 35*a* and via the tension element 41 a and through compression element 30*a* to the pistons 22*a* and via the tension element 41*b* and through compression element 30*b* to the pistons 22*b*. The initial tension of the belt 40*a* is set such that, during this portion of the cycle of the pump 10*a*, residual tension remains in the tension elements 42*a*, 42*b*.

When the pistons 21*a*,22*a* of pair 20*a* reach and pass their rightmost positions in the figures, the motion of the pistons 21*b*,22*b* of pair 20*b* and the compression element 30*b* are at the centers of their strokes and moving upward in FIG. 4 as described immediately above. As for pair 20*a*, direction reversal occurs. The inlet valve 51 in the cylinder 13*a* and the outlet valve 52 in the cylinder 14*a* close as the pistons begin to reverse direction from that toward the right in the figures and toward the left. At this point in the cycle, the valve 51 in the cylinder 14*a* opens, beginning its intake stroke, and the valve 52 in the cylinder 13*a* opens, beginning its output stroke. In this portion of the cycle, the force to move the piston 22*a* inwardly is applied by the motor 12 through the shaft 16 and the plate 35*a* and via the tension element 42*a* to the piston 22*a*. The force to move the piston 21*a* outwardly is similarly supplied by the motor 12 through the shaft 16 and the plate 35*a* and via the tension element 42*a* and further through compression element 30*a* to the piston 21*a*. The initial tension of the belt 40*a* is set such that, during this portion of the cycle of the pump 10*a*, residual tension remains in the tension element 41*a*.

At a point 90° later in the cycle, the motion of the components of pair 20*a* continues as described immediately above with a direction reversal occurring in the components of pair 30*b*, as the pistons 21*b*,22*b* start to move downwardly from the top point in their cycles. The motion continues as the eccentric disc 35*a* rotates around the axis 15 and through the cycles of the pump 10*a*.

Figure 6:
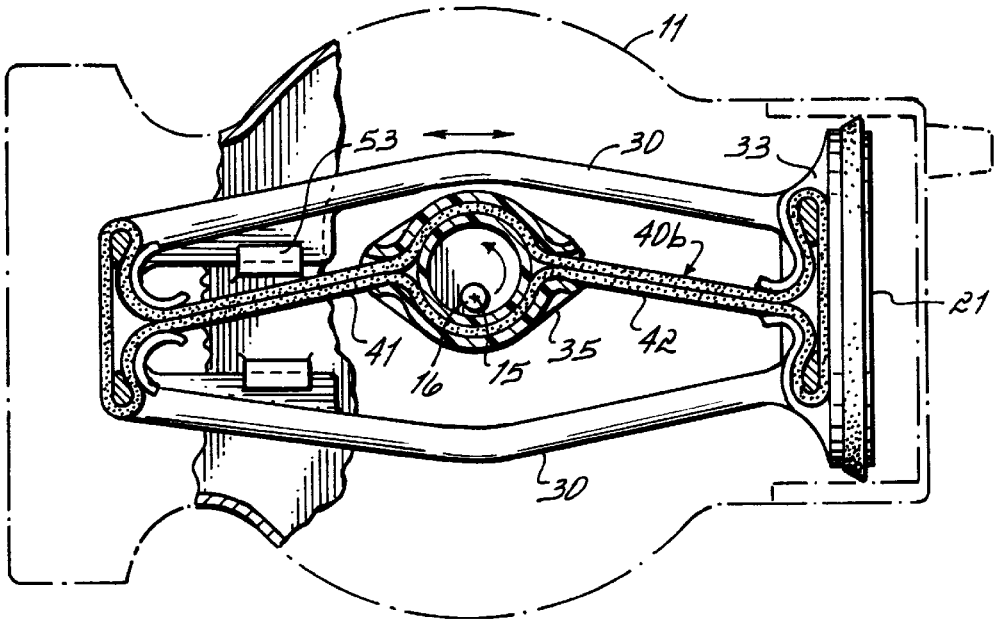
FIG. 6 is a schematic plan view illustrating a further embodiment of the invention.
Figure 7:
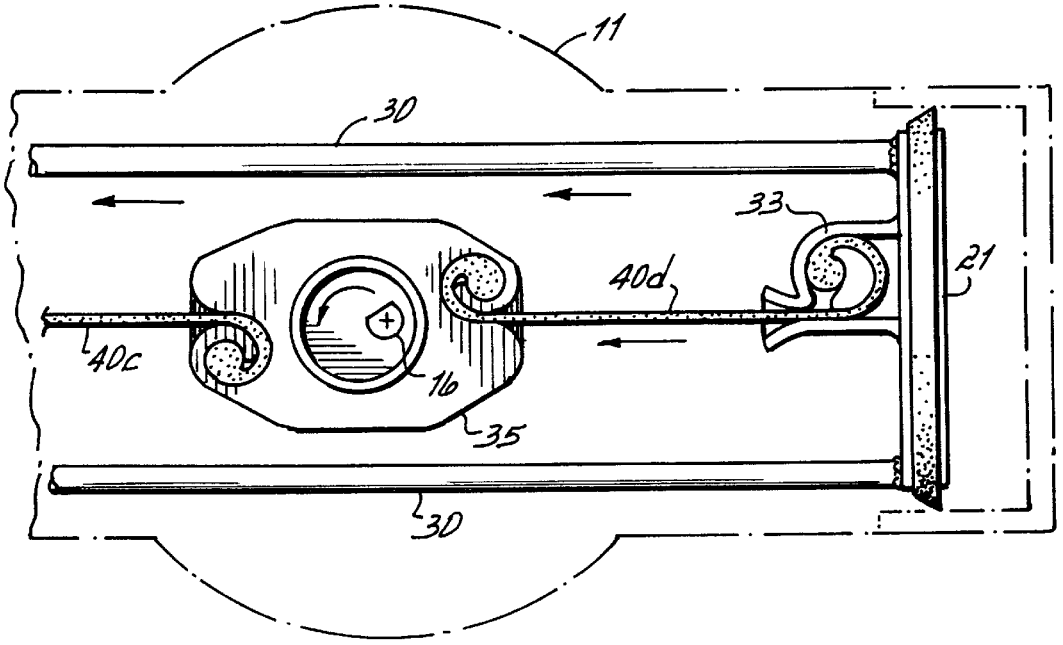
FIG. 7 is a schematic plan view illustrating another embodiment of the invention.

While the embodiments 10 and 10*a* above illustrate a common belt 40, 40*a* as providing the tension elements 41*a*,42*a*,41*b*,42*b*, other configurations of the tension elements can be employed. For example, in FIG. 6, a single endless belt 40*b* is clamped to a single piston 21 and to the central disc 35 to form the tension elements 41,42. The opposite end of the piston 21 is free to slide on a pair of channels 53 which are fixed of housing 11. In FIG. 7, separate belt segments 40*c*,40*d* clamped at the opposite ends thereof to posts 33 and plate 35, form the tension elements 41,42.

Figure 3:
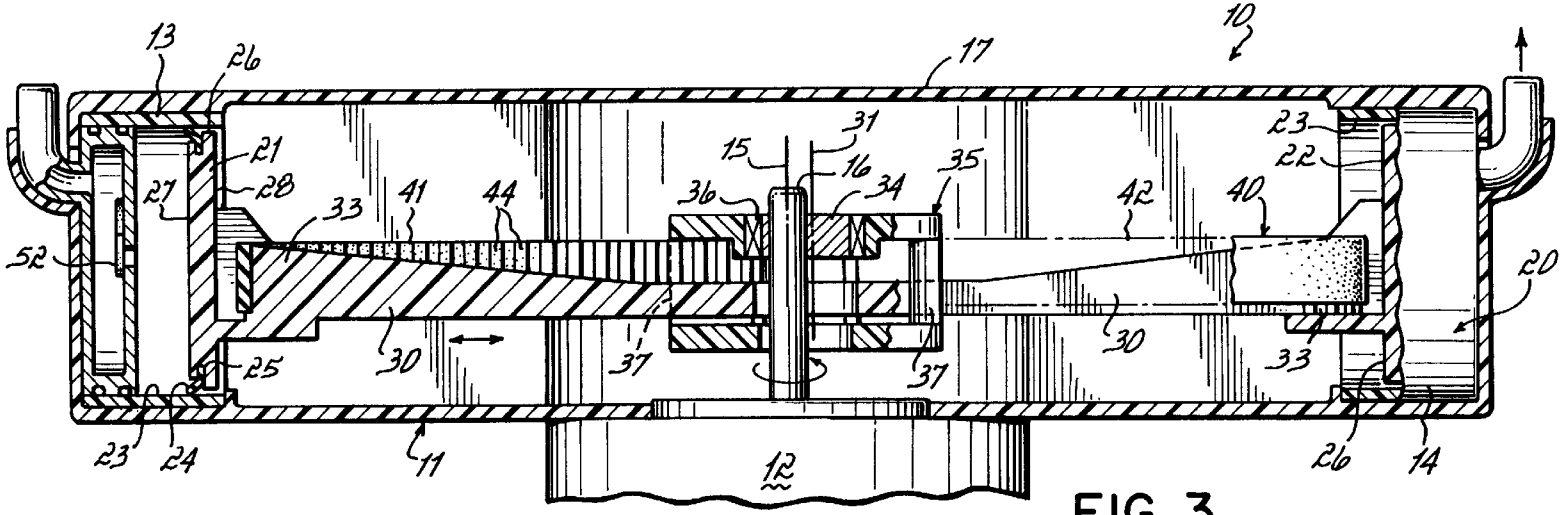
FIG. 3 is a cross-sectional view taken along the line 3—3 of FIG. 2.
Figure 3A:
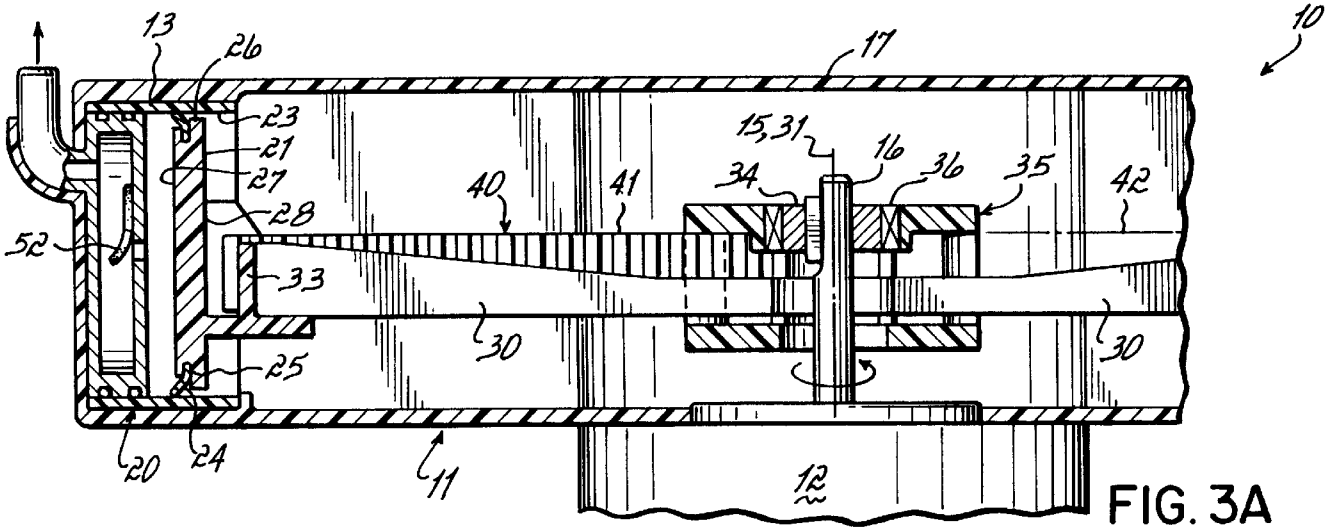
FIG. 3A is a cross-sectional view taken along the line 3A—3A of FIG. 2A.
Figure 8:
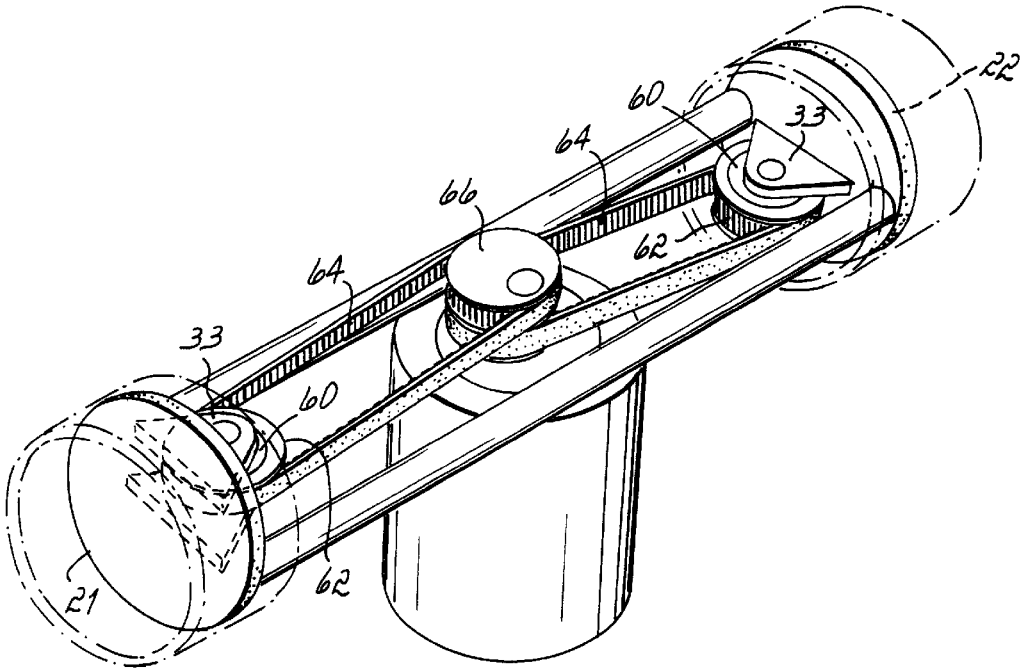
FIG. 8 is a schematic perspective view, similar to FIG. 1, of a further embodiment of the invention.

FIG. 8 illustrates a further embodiment 10*b* of a pump that is similar to the pump 10 of FIGS. 2–3, except that instead of a single bearing around the disc 34 on the shaft 16 of the motor 12 and the orbital drive plate 35, a single bearing 60 and a rotatable pulley 62 is provided at the post 33 of each of the pistons 21, 22. Tension elements 64 are provided in the form of an endless belt around each of the pulleys 39 and an eccentric disc 66 which is configured to receive the belts. Cogged belts may be provided for the elements 64 with cogs on one, or preferably both, of the disc 34*a* and pulleys 39.

Figure 9:
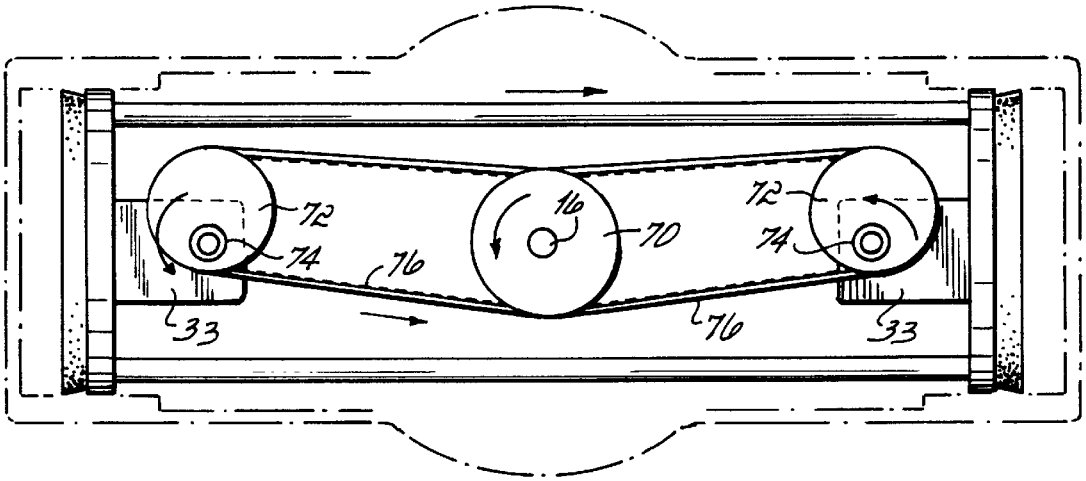
FIG. 9 is a schematic plan view of a further embodiment of the invention.

In the further embodiment of FIG. 9, a disc 70 is provided that is concentrically mounted and fixed to the shaft 16, and each of the posts 33 has an eccentrically mounted pulley 72 rotatably mounted thereon with bearing 74. The belts forming the tension elements 76 are cogged to positively drive the eccentrically mounted pulleys 72. This embodiment provides for longer piston strokes with less transverse motion of the nature that would change the length of the path spanned by the belt.

Those skilled in the art will appreciate that the applications of the present invention are varied, that the invention is described in its preferred embodiments and, accordingly, that additions and modifications can be made to that described above without departing from the principles of the invention.

Therefore, the following is claimed:

1. A positive displacement pump comprising:

a housing;

a plurality of pistons;

a drive element continuously unidirectionally rotatable relative to the housing;

a rigid compression member connected to each of the pistons and reciprocatably moveable with the pistons relative to the housing; and tension means connected between the drive element and each of the pistons for reciprocating the pistons in response to the continuous unidirectional rotation of the drive element, the tension means including a tension element permanently maintained in tension so as to continuously exert radially inward force on the compression member to permanently maintain the compression member in compression so as to continuously exert radially outward force on the pistons connected thereto;

each piston being driven inwardly by the drive element through force exerted through the tension means and being driven outwardly by the drive element through force exerted through the tension means to and through the rigid compression member.

2. The pump of claim 1 wherein:

the plurality of pistons includes at least one pair of pistons linked together by the compression member.

3. A positive displacement pump comprising:

a housing;

in input drive shaft mounted for continuously unidirectional rotary motion about an axis relative to the housing;

a plurality of pistons each mounted for reciprocating motion on the housing;

at least one eccentric drive element linked to the input drive shaft and mounted for continuous unidirectional rotary motion in synchronism therewith;

at least one rigid compression member connected to each of the pistons and reciprocatably moveable with the pistons relative to the housing;

the plurality of pistons including at least one pair of opposed pistons linked together by one of the at least one compression member; and at least one tension member connecting each of the pistons in series with the at least one eccentric drive element, the at least one tension member being permanently maintained in tension so as to continuously exert unidirectional force on each of the pistons and on the at least one compression member to permanently maintain the compression member in compression; each of the opposed pistons of the pair being moved in the direction of the other piston of the pair by the force exerted by the tension member which in turn moves said other piston through compressive force exerted between the pistons of the pair by the at least one compression member, whereby the pistons of the pair reciprocate in unison with the continuous unidirectional rotary motion of the input drive shaft.

4. The pump of claim 3 wherein:

the tension member has a greater longitudinal elasticity in tension than the compression member has in compression.

5. The pump of claim 3 wherein:

the plurality of pistons includes a plurality of pairs of opposed pistons;

the at least one rigid compression member includes a plurality of rigid compression members, each linking together the opposed pistons of one of the pairs of opposed pistons to reciprocate each of the pistons of each respective pair in synchronism 180° out of phase with the other.

6. The pump of claim 3 wherein:

the at least one tension member includes a transversely flexible elongated element connected in series with an eccentric drive element connected between the input drive shaft and at least one of the pistons.

7. The pump of claim 3 wherein:

the at least one tension member includes a plurality of transversely flexible elongated elements, each connected in series with an eccentric drive element and connected between the input drive shaft and one of the pistons.

8. The pump of claim 3 wherein:

the at least one tension member includes at least one endless belt of transversely flexible elongated material connected at an extent thereof to an eccentric drive element and linked at another extent thereof to at least one of the pistons.

9. The pump of claim 3 wherein:

the at least one tension member includes a plurality of endless belts of transversely flexible elongated material, each connected at one extent thereof to an eccentric drive element and each linked at another extent thereof to one of the pistons.

10. The pump of claim 3 wherein:

the at least one tension member includes an endless belt of transversely flexible elongated material connected in series with the at least one eccentric drive element and interconnecting each of the pistons and the input drive shaft.

11. A positive displacement pump comprising:

a housing;

a plurality of pistons;

an eccentric drive element rotatably mounted on an axis to the housing;

a rigid compression member connected to each of the pistons and reciprocatably moveable with the pistons relative to the housing; and at least one tension member connecting each of the pistons to the eccentric drive element at a point displaced from the axis, the at least one tension member being permanently maintained in tension so as to continuously exert force radially inwardly on each of the pistons and to cause each of the pistons to continuously exert radially inward force on the compression member to permanently maintain the compression member in compression; and one and only one bearing between the drive element and the pistons.

12. A positive displacement pump comprising:

a housing;

a piston;

a drive element continuously unidirectionally rotatable relative to the housing;

a rigid compression member connected at a first end to the piston with a second end extending to the opposite side of the drive element from the piston, the compression member being reciprocatably moveable with the piston relative to the housing; and at least one tension member connecting the drive element and first and second ends of the compression member so as to reciprocate the piston in response to the continuous unidirectional rotation of the drive element.

13. The pump of claim 12 wherein:

the drive element includes an input drive shaft continuously unidirectionally rotatable about an axis on the housing;

the piston has an eccentric element rotatably fixed thereto continuously unidirectionally rotate about an axis thereon;

the at least one tension member includes an endless belt driveably interconnecting the eccentric element and the shaft to reciprocate the piston in response to the continuous unidirectional rotation of the eccentric element through continuous unidirectional motion of the belt in responds to the continuous unidirectional rotation of the shaft.

14. The pump of claim 13 further comprising:

a second piston connected to the second end of the compression member.

15. The pump of claim 12 wherein:

the drive element includes an input drive shaft and an eccentric element fixed to the shaft to continuously unidirectionally rotate therewith about an axis;

the at least one tension member driveably contacting the eccentric element remote from the axis.

* * * * *

UNITED STATES PATENT AND TRADEMARK OFFICE

CERTIFICATE OF CORRECTION

PATENT NO. : 6,148,716
DATED : November 21, 2000
INVENTOR(S) : Robert P. Swank

It is certified that error appears in the above-identified patent and that said Letters Patent is hereby corrected as shown below:

Column 2,
Line 50, delete "levels" and insert therefor -- level --.

Column 3,
Line 1, after "as well", insert -- as --.

Column 6,
Line 32, delete "is illustrated" and insert therefor-- as illustrated --.
Line 46, delete "when".

Column 8,
Line 21, after "elements", delete the comma ",".
Line 66, delete "41 a" and insert therefor -- 41a --.

Column 10, claim 3,
Line 35, delete "in input drive" and insert therefor -- an input drive --.

Column 12, claim 13,
Line 30, delete "rotate" and insert therefor -- rotatable --.
Line 38, delete "responds" and insert therefor -- response --.

Signed and Sealed this

First Day of January, 2002

*Attest:*

*Attesting Officer*

JAMES E. ROGAN
*Director of the United States Patent and Trademark Office*